United States Patent [19]

Sugiyama et al.

[11] 4,071,502

[45] Jan. 31, 1978

[54] POLYESTER FIBER HAVING ANTI-PILLING PROPERTY AND ITS PRODUCTION

[75] Inventors: Hiroshige Sugiyama; Hiroshi Yasuda, both of Otsu, Japan

[73] Assignee: Toyo Boseki Kabushiki Kaisha, Osaka, Japan

[21] Appl. No.: 568,535

[22] Filed: Apr. 14, 1975

Related U.S. Application Data

[63] Continuation of Ser. No. 415,473, Nov. 13, 1973, abandoned.

[30] Foreign Application Priority Data

Nov. 14, 1972 Japan ..... 47-114559

[51] Int. Cl.[2] ..... C08G 63/70; C08G 63/18

[52] U.S. Cl. ..... 260/75 T; 264/210 F; 264/290 T

[58] Field of Search ..... 260/75 T; 264/210 F, 264/290 T

[56] References Cited

U.S. PATENT DOCUMENTS

| | | | |
|---|---|---|---|
| B 292,300 | 1/1975 | Reese | 264/210 F |
| 3,104,450 | 9/1963 | Christens et al. | 260/75 T X |
| 3,118,012 | 1/1964 | Kilian | 264/176 F |
| 3,245,955 | 4/1966 | Rieber | 260/75 T |
| 3,396,446 | 8/1968 | Eggleston et al. | 260/75 T X |
| 3,452,132 | 6/1969 | Pitzl | 264/290 T |
| 3,480,586 | 11/1969 | Forster et al. | 260/785 T X |
| 3,511,905 | 5/1970 | Martin | 264/210 F |
| 3,681,826 | 8/1972 | Bergwerk | 264/210 F X |
| 3,816,486 | 6/1974 | Vail | 260/75 T X |
| 3,838,561 | 10/1974 | Munting | 264/290 T X |

*Primary Examiner*—Walter C. Danison
*Attorney, Agent, or Firm*—Barry Kramer

[57] ABSTRACT

An anti-pilling polyester fiber having an intrinsic viscosity of 0.32 to 0.48 which has the following physical properties: tenacity, 3.5 to 5.0 g/d; knot tenacity, not more than 3.0 g/d; ratio of tenacity and knot tenacity, not less than 1.5.

5 Claims, No Drawings

POLYESTER FIBER HAVING ANTI-PILLING PROPERTY AND ITS PRODUCTION

This is a continuation of application Ser. no. 715,473, filed Nov. 13,1973, now abandoned.

The present invention relates to a polyester fiber having an anti-pilling property and its production. More particularly, it relates to a polyester staple fiber having an anti-pilling property which is suitable for spinning along or blend spinning with cotton.

Polyester fibers, particularly fibers of a polyester having an ethylene terephthalate chain as the main constituent unit, are excellent in dimensional stability, crease recovery, wash & wear property and the like. Thus, they are very useful for manufacture of clothes. When, however, they are fabricated in the form of clothers, pills are apt to be produced during the use (e.g. wearing) whereby the appearance may be much deteriorated (this phenomenon being called "pilling"). In order to prevent such unfavorable pilling, there have been proposed some methods, of which typical ones are as follows:

1. The fibers are processed to manufacture fabrics, which are then subjected to surface treatment such as shearing and singeing. By such treatment, the fiber ends are eliminated so that the production of pills is prevented.

2. The fibers are subjected to hydrolysis with an alkali or an amine to reduce the degree of polymerization of polyester whereby the fibers are made fragile and the produced pills are readily eliminated.

3. A polyester having a low degree of polymerization is used for the manufacture of fibers so that the resulting fibers have a low strength. Pills are eliminated in the same manner as in (2).

4. Polyvalent carboxylic acids or alcohols having not less than three functional groups are subjected to copolymerization, and the resulting non-linear polyesters are used for the manufacture of fibers.

Among them, the method (1) does not produce a substantial improvement in the quality of the fibers. Therefore, it is almost impossible to achieve a good anti-pilling effect when the fabrics are of coarse texture or the yarns are of small number of twist. Further, the method (2) is per se quite effective in providing with an anti-pilling property. Since, however, the uniform proceeding of the hydrolysis is difficult, a tendency of producing unevern dyeing is seen. Moreover, in the method (4), cross linking of the produced polymers tends to take place on melting whereby gel is formed. Such gel formation causes much troubles in melt spinning. In addition, this method is not sufficiently effective in affording an anti-pilling property.

After all, the method (3) seems to be the most suitable. Even in this method, however, the following disadvantages are recognized:

a. Since the tenacity is low, yarn breakage may occur in a spinning step, particularly in a ring spinning frame. When blend spun with cotton, there is ususally adopted a high speed spinning, for instance, at a spindle rotation of about 14,000 rpm. In case of polyester fibers of a high anti-pilling property being used for such blend spinning, the spindle rotation is obliged to be considerably lowered, for instance, below about 10,000 rpm in order to avoid yarn breakage. This is apparently disadvantageous, because the production efficiency is necessarily lowered with the elevation of the production cost.

b. The undrawn filaments obtained by spinning a polyester of low degree of polymerization is very breakable, and breakage may often occur on drawing. Further, unevenness of filaments are frequently caused by uneven drawing. Moreover, the undrawn filaments made of a polyester of low degree of polymerization are difficultly drawn after left to stand for a long period of time. Thus, the strict control of the period of time for leaving and the drawing condition is necessary.

A main object of the present invention is to provide a novel polyester fiber having a good anti-pilling property, which is suitable for blend spinning with cotton. Another object of this invention is to provide a polyester fiber which does not produce any yarn breakage even when spun at a high speed. A further object of the invention is to provide a process for preparing a polyester fiber having a good anti-pilling property and producing no breakage even on a high speed spinning from a polyester of low degree of polymerication without any trouble. A still further object of the invention is to provide a process for preparing a polyester fiber having a good anti-pilling property which does not require any strict control on the period of time leaving and the drawing condition. These and other objects will be apparent to those conversant with the art to which the present invention pertains from the foregoing and subsequent descriptions.

The fiber of this invention does not produce any breakage on spinning and is provided with a good anti-pilling property. Such polyester fiber has an intrinsic viscosity (IVf) = 0.32 to 0.48 and has the following physical properties: tenacity (DT), 3.5 to 5.0 g/d; knot tenacity (KT), not more than 3.0 g/d; ratio of tenacity and knot tenacity (DT/KT), not less than 1.5. In addition, the fiber may be preferably not less than 0.170 birefringence ($\Delta n$).

For production of the said fiber, an undrawn filament made of a linear polyester having an intrisic viscosity of 0.32 to 0.48 and having a birefringence of 0.015 to 0.080 may be drawn at a temperature of not lower than about 80° C to make a drawn film having a birefringence of not less than 0.170. The starting undrawn filament may be produced preferably by melt spinning a linear polyester at a take-up velocity of 1,600 to 4,000 m/min.

In the production of conventional anti-pilling polyester fibers, it has been considered to be essential to keep the tenacity low. For this purpose, a polyester of low degree of polymerization has been used as the starting material. When a polyester of low degree of polymerization is used as the starting material for production of fibers, the obtainment of a high tenacity is practically impossible, because breakage and uneveness tend to occur on drawing.

In the present invention, there is used an undrawn filament having a high birefringence, which may be produced by melt spinning at a high velocity, for the manufacture of a drawn filament. By the use of such undrawn filament, it has been for the first time made possible to effect drawing evenly under a high tension and to produce a uniformly drawn filament having a high tenacity. It has also been made possible to obtain a good anti-pilling polyester fiber from such drawn filament of high tenacity by suppressing the knot tenacity sufficiently.

The polyester fiber of the invention is a linear polyester having an intrinsic viscosity of 0.32 to 0.48. The intrinsic viscosity as herein shown indicates the value determined at 30° C in a mixture of phenol and tetrachloroethane (60 : 40 in weight ratio). When the intrinsic viscosity is less than 0.32, spinning becomes difficult. When it is more than 0.48, a good anti-pilling property can not be achieved.

As the linear polyester, there may be used a polyester mainly consisting of terephthalic acid units and glycol units, preferably polyethylene terephthalate or a copolyester containing not less than 85 mol % of ethylene terephthalate units. In case of the copolyester, the copolymerizable units may be derived from dicarboxylic acids (e.g. isophthalic acid, sebacid acid, adipic acid), hydroxycarboxylic acids (e.g. p-hydroxybenzoic acid) and diols (e.g. trimethylene glycol, tetramethylene glycol, diethylene glycol, polyethylene glycol, cyclohexanedimethanol), and their derivatives.

The values concerning to the tenacity and the knot tenacity indicate the average values determined on 50 test specimens at a grip distance of 20 mm under the normal state (i.e. temperature, 20° C; relative humidity, 65%) by the use of a tensile tester of constant rate of specimen extension according to the procedure as described in JIS (Japanese Industrial Standard) L 1069.

The maintenance of the tenacity being not less than 3.5 g/d is essential to carry out smoothly the high speed spinning (e.g. at a spindle rotation of 14,000 rpm). The maintenance of the knot tenacity, the ratio of the tenacity and the knot tenacity and the tenacity being respectively not more than 3.0 g/d, not less than 1.5 and not more than 5.0 g/d is necessary for achievement of a good anti-pilling property. Preferably, the tenacity may be from 3.8 to 4.5 g/d and the knot tenacity may be not more than 2.5 g/d. The favorable value for the ratio of the tenacity and the knot tenacity is not less than 1.8.

The tensile elongation at bread may be usually from 10 to 20%, preferably from 12 to 18%. Further, the knot elongation may be generally from 7 to 16%.

The birefringence of the polyester fiber is favorably not less than 0.170, more favorably not less than 0.180. The birefringence herein employed represents the value determined using a unicolor light source of 589.3 mμ in wavelength by the aid of a Berek compensator. Such a high value of birefringence as above indicates that the fiber of the invention possesses an inner structure of extremely high orientation, which has never seen in any conventional fiber made of a polyester of low degree of polymerization.

The section of the polyester fiber of the invention may be of any shape. For instance, it may be circular, polyangular (e.g. triangular, square, pentagonal), multilobal (e.g. trilobal, tetralobal, pentalobal), etc.

The fiber may be constituted with a single component or multi components. Thus, it may be a conjugate fiber. In this case, the said values (e.g. intrinsic viscosity, birefringence) represent the average values.

The monofilament denir of the fiber of the invention may be usually not more than 5 denir, particularly from 0.5 to 2 denir. In the case of such small denir, the effect of this invention may be exerted more remarkably.

For the manufacture of the anti-pilling polyester fiber according to this invention, there may be first produced an undrawn filament having an intrinsic viscosity of 0.32 to 0.48, the birefringence of the undrawn filament being 0.015 to 0.080, by melt spinning. Then, the undrawn filament may be drawn at a temperature not lower than about 80° C to make a drawn filament of which the birefringence is not less than 0.170.

Drawing of an undrawn filament having a low intrisic viscosity and a small birefringence to make a birefringence of not less than 0.170 frequency produces breakage or fuzz as well as unevenness in the resulting filament. In addition, the produced drawn filament has unevenness. Thus, the operation is practically impossible. Although the performance of drawing at multi stages with slow velocities may be considered, it is not industrially advantageous. Besides, the undrawn filament as stated above is much influenced by the elapse of time so that difficulty is encountered on drawing. These defects can be all overcome by the use of an undrawn filament having a birefringence of 0.015 to 0.080 (preferably 0.025 to 0.060) according to this invention. Such an undrawn filament as having a high birefringence may be produced by melt spinning at a high speed, i.e. by taking up a melt spun filament at a high velocity. The take-up velocity may be ususally from 1,600 to 4,000 m/min, favorably from 2,000 to 3,500 m/min. The birefringence of an undrawn filament is favored to be higher. In order to obtain an undrawn filament of which the birefringence is over 0.080, however, a higher take-up velocity than 4,000 m/min is needed, for which a complex and expensive melt spinning machine must be equipped. Even if so, the manufacture of a uniform undrawn filament is difficult.

The drawing of the said undrawn filament may be carried out at a temperature not lower than about 80° C under a high tension in a single stage or multi stages so as to make a drawn filament of which the birefringence is not less than 0.170, preferably not less than 0.170, preferably not less than 0.180. A higher drawing temperature results in a lower knot tenacity and a better pilling property. A preferred drawing temperature is from 140° to 220° C. When the temperature is higher than about 220° C, the monofilaments weld each other on drawing whereby filament breakage is caused. In case of the drawing being carried out in two stages, the one at the first stage is performed to a certain extent and the one at the second state is effected under a high tension for completion. The tension for drawing may be not less than 0.7 g/d, preferably from 0.8 to 1.5 g/d.

As an apparatus for drawing, there may be used, for instance, the one provided with a hot bath, a steam bath, a hot plate or the like between two rollers, the one equipped with hot rollers, etc.

When desired, heat treatment or any other treatment may be effected after the drawing.

The filaments after drawing is ordinarily provided with crimps by the aid of a conventional apparatus for crimping such as a stuffer boy type crimper, followed by heat treatment for fixation of the crimps and then cutting in appropriate length to give crimped stable fibers. Alternatively, the crimped filaments may be first cut in suitable length and then heat treated to obtain crimped stable fibers. A proper length of staple fibers is usually from 30 to 60 mm. On the heat treatment for fixation of the crimps, the birefringence may be somewhat lowered. Taking this fact into consideration, the birefringence of the crimped staple as the starting material in the production of fabrics is desired to be adjusted to not less than 0.170.

The anti-pilling polyester fibers of the invention may be subjected to spinning with or without any other fibers such as cotton. Breakage of yarns is scarcely recognized even when spun at a high speed, for instance, at a spindle speed of 14,000 rmp. The fabrics manufactured by the use of such fibers exhibit an excellent anti-pilling property of Grade 4 or higher in the test using an ICI type pilling tester.

It is of great advantage that the said anti-pilling polyester fibers can be produced from a polyester of low degree of polymerization under a stable condition without any trouble such as filaments breakage and unevenness.

Practical and presently preferred embodiments of the present invention are illustratively shown in the following Examples wherein the anti-pilling property and the spinnability were dctermined as follows:

Anti-pilling Property

A specimen was applied to an ICI pilling tester which was operated at 60 rpm. After 5 hours, the surface condition of the specimen (knitted fabric) was evaluated macroscopically in comparison with the standard photographs for judgment ranked into 1 - 5 grades. The value as indicated is the average value of 4 specimens (cf. JIS L 1076).

Spinnability

The frequency of yarn breakages per hour was counted on 400 spinning spindles. The spinning spindle rotation was 14,000 rpm.

EXAMPLE 1

Polyethylene terephthalate of 0.38 intrinsic viscosity was subjected to melt spinning through a spinning nozzle having 300 outlets at a spinning temperature of 270° C and a take-up velocity of 2,500 m/min to obtain an undrawn tow having an intrinsic viscosity of IVF = 0.37 and a birefringence of $\Delta n = 0.025$. Then, this was drawn to 3.0 times with 90° C steam and 120° C hot plate to obtain a drawn tow comprising 1.5 denier monofilaments. The birefringence of the drawn tow was $\Delta n = 0.191$. The drawn tow was crimped by a stuffer-box type crimper and subjected to dry heat treatment at 160° C for 1 minute, after which it was cut into 38 mm to prepare the spinning staple No. 1.

EXAMPLE 2

The same undrawn tow as in Example 1 was drawn to 2.8 times with 90° C steam and 180° C hot plate to obtain a drawn tow comprising 1.7 denier monofilaments ($\Delta n = 0.185$). The resulting filaments were similarly crimped, subjected to dry heat treatment and cut to prepare the spinning staple No. 2.

EXAMPLE 3

The same undrawn tow as in Example 1 was drawn to 3.2 times in a hot bath of 100° to obtain a drawn tow comprising 1.4 denier monofilaments ($\Delta n = 0.203$). The resulting filaments were similarly crimped, subjected to dry heat treatment and cut to prepare the spinning staple No. 3.

EXAMPLE 4

A copolymer of polyethylene terephthalate/isophthalate having an intrinsic viscosity of 0.41 (isophthalate component, 10 mol %) was subjected to melt spinning through a spinning nozzle having 300 outlets at a spinning temperature of 240° C and a take-up velocity of 2,500 m/min to obtain an undrawn tow having a intrinsic viscosity of IVf = 0.40 and a birefringence of $\Delta n = 0.027$. Then, this was drawn to 3.0 times with 90° C and 140° C hot plate to obtain a drawn tow comprising 1.5 denier monofilaments ($\Delta n = 0.182$). The resulting tow was crimped, subjected to dry heat treatment and cut in the same manner as in Example 1 to prepare the spinning staple No. 4.

EXAMPLE 5

Polyethylene terephthalate of 0.43 intrinsic viscosity was subjected to melt spinning through a spinning nozzle having 300 outlets at a spinning temperature of 280° C and a take-up velocity of 3,200 m/min to obtain an undrawn tow having an intrinsic viscosity of IVf = 0.42 and a birefringence of $\Delta n = 0.043$. Then, this was drawn to 2.5 times with 90° C steam and 120° C hot plate to obtain a drawn tow comprising 1.7 denier monofilaments ($\Delta n = 0.192$). The resulting tow was crimped, subjected to dry heat treatment and cut in the same manner as in Example 1 to prepare the spinning staple No. 5.

Comparative Example 1

Polyethylene terphthalate of 0.54 intrinsic viscosity was subjected to melt spinning through a spinning nozzle having 300 outlets at a spinning temperature of 300° C and a take-up velocity of 2,500 m/min to obtain an undrawn tow having an intrinsic viscosity of IVf = 0.52 and a birefringence of $\Delta n = 0.030$. Then, this was drawn to 3.4 times with 90° C steam and 120° C hot plate to obtain a drawn tow comprising 1.4 denier monofilaments ($\Delta n = 0.196$). The resulting tow was crimped, subjected to dry heat treatment and cut in the same manner as in Example 1 to prepare the spinning staple No. 1'.

COMPARATIVE EXAMPLE 2

Polyethylene terephthalate of 0.38 intrinsic viscosity was subjected to melt spinning through a spinning nozzle having 300 outlets at a spinning temperature of 270° C and a take-up velocity of 1,300 m/min to obtain an undrawn tow having an intrinsic viscosity of IVf = 0.37 and a birefringence of $\Delta n = 0.010$. Then, this was drawn to 5.0 times with 90° C steam and 180° C hot plate, in the course of which the filaments were broken to prevent drawing. So, the same undrawn tow was drawn to 4.2 times with 90° C steam and 180° C hot plate to obtain a drawn tow comprising 1.4 denier monofilaments ($\Delta n = 0.136$). The resulting tow was crimped, subjected to dry heat treatment and cut in the same manner as in Example 1 to prepare the spinning staple No. 2'.

The results of measurements on the tenacity DT (g/d), the tensile elongation at break DE (%), the knot tenacity KT (g/d) and the knot elongation KE (%) of the staples shown in Examples 1 to 5 and Comparative Examples 1 and 2 are shown, together with the frequency of filament breakages in the course of drawing (times/10 min), in Table 1.

Also, the anti-pilling property of the product obtained by applying each of the said staple to a ring spinning frame to make 30S spun yarns and knitting them by the aid of a 18 gauge plain knitting machine and the spinnability of the said yarns are shown in Table 1.

Table 1

| Staple No. | Frequency of breakages during drawing (times/10 min.) | DT (g/d) | DE (%) | KT (g/d) | KE (%) | DT/KT | Spinnability (frequency of yarn breakages) | Anti-pilling Property (Grade) |
|---|---|---|---|---|---|---|---|---|
| 1 | 1 | 4.2 | 12 | 2.5 | 8 | 1.68 | 1 | 5 |
| 2 | 0 | 3.8 | 18 | 2.2 | 13 | 1.73 | 3 | 5 |
| 3 | 0 | 4.4 | 15 | 2.0 | 10 | 2.20 | 1 | 5 |
| 4 | 0 | 3.6 | 20 | 2.4 | 16 | 1.50 | 4 | 5 |
| 5 | 0 | 4.6 | 18 | 1.8 | 11 | 2.55 | 0 | 5 |
| 1' | 2 | 5.2 | 18 | 2.6 | 12 | 2.00 | 0 | 3 |
| 2' | 0 | 2.8 | 26 | 2.6 | 23 | 1.08 | More than 20 | 5 |

As in apparent from the above Table, the filaments according to the invention (No. 1 - No. 5) having a satisfactory behavior to drawing, a sufficient tenacity to exhibit a good spinnability and a favorable anti-pilling property.

EXAMPLE 6

Polyethylene terephthalate of 0.38 intrinsic viscosity was subjected to melt spinning through a spinning nozzle having 300 outlets at a spinning temperature of 270° C and a take-up velocity of 2,500 m/min to obtain an undrawn tow having an intrinsic viscosity of IVf = 0.37 and a birefringence of $\Delta n = 0.025$. Two devices provided with double heating plates (i.e. upper and lower plates) between two rollers which have different rotation speeds were equipped, and the undrawn tow which elapsed more than 7 days after melt spinning was passed through them to give two stage drawing. The drawing conditions were 3.0 times at 180° C for the first state and 1.2 times at 180° C for the second stage. The breakage of the tow at the time of drawing was nil, the monofilament denier of the drawn tow was 1.5 d and the birefringence was $\Delta n = 0.197$. This tow was machine-crimped, dry heat treated and set in the same manner as in Example 1 to prepare the spinning staple. The fiber quality was tested to show DT = 3.9 g/d, KT = 2.4 g/d and DT/KT = 1.62. It displayed a favorable spinnability and an anti-pilling property of Grade 5.

EXAMPLE 7

Polyethylene terephthalate/isophthalate copolymer having an intrinsic viscosity of 0.43 (isophthalate component, 10 mol %) was subjected to melt spinning through a spinning nozzle having 300 outlets at a spinning temperature of 255° C and a take-up velocity of 3,000 m/min to obtain an undrawn tow having an intrinsic viscosity of IVf = 0.42 and a birefringence of $\Delta n = 0.025$. With the same devices as used in Example 6, this was subjected to two stage drawing, i.e. 2.4 times at 100° C for the first stage and 1.3 times at 150° C for the second stage. At the time of drawing, no breakage was observed, and the obtained drawn tow had a monifilament denier of 2.0 d and a birefringence of $\Delta n = 0.175$. The fiber quality of the staple made through the same process as in Example 6 was tested to show DT = 4.0 g/d, KT = 2.65 g/d and DT/KT = 1.51 with a favorable spinnability and an anti-pilling property of Grade 4.5.

Comparative Example 3

Polyethylene terephthalate of 0.38 intrinsic viscosity was subjected to melt spinning through a spinning nozzle having 300 outlets at a spinning temperature of 270° C and a take-up velocity of 1,200 m/min to obtain an undrawn tow having an intrinsic viscosity of IVf = 0.37 and a birefringence of $\Delta n = 0.0075$. With the same devices as used in Example 6, this undrawn tow was subjected to two stage drawing on the conditions of 4.0 times at 100° C for the first stage and 1.3 times at 180° C for the second stage, during which frequent breakages occured to prevent resumption of drawing.

The undrawn tow of this Example was drawn under various drawing temperatures and drawing times, the tenacity of the drawn tow obtainable under the conditions of non-breakage was 2.8 g/d at most, and it was impossible to prevent the yarn breakages at the spinning unless the spinning spindle rotation is reduced below 10,000 rpm.

What is claimed is:

1. An anti-pilling polyester fiber having an intrinsic viscosity of 0.32 to 0.48 as determined in a solvent mixture consisting of phenol and tetrachloroethane in a weight ratio of 6:4 at 30° C. which has the following physical properties:

Tenacity = 3.5 to 5.0 g/d;
Knot Tenacity = not more than 3.0 g/d;
Ratio of Tenacity to Knot Tenacity = not less than 1.5;
Birefringence = not less than 0.170; and
Tensile elongation at break = 10 to 20%.

2. The anti-pilling polyester fiber according to claim 1, wherein the fiber has a monofilament denier of not more than 5 denir.

3. The anti-pilling polyester fiber according to claim 2, wherein the fiber has a monofilament denir of 0.5 to 2 denir.

4. The anti-pilling polyester fiber according to claim 1, wherein the fiber is mechanically crimped.

5. The anti-pilling polyester fiber according to claim 1, wherein the linear polyester contains not less than 85 mol % of ethylene terephthalate units.

* * * * *